US012796869B2

(12) United States Patent
He et al.

(10) Patent No.: US 12,796,869 B2
(45) Date of Patent: Nov. 17, 2026

(54) SHOWER CHAIR

(71) Applicant: ZHEJIANG JIECANG LINEAR MOTION TECHNOLOGY CO., LTD., Shaoxing (CN)

(72) Inventors: Quansheng He, Shaoxing (CN); Liuchang Lu, Shaoxing (CN); Shengxin Zheng, Shaoxing (CN)

(73) Assignee: ZHEJIANG JIECANG LINEAR MOTION TECHNOLOGY CO., LTD., Shaoxing (CN)

( * ) Notice: Subject to any disclaimer, the term of this patent is extended or adjusted under 35 U.S.C. 154(b) by 84 days.

(21) Appl. No.: 18/872,662

(22) PCT Filed: Jun. 29, 2023

(86) PCT No.: PCT/CN2023/103786

§ 371 (c)(1),
(2) Date: Dec. 6, 2024

(87) PCT Pub. No.: WO2024/045849

PCT Pub. Date: Mar. 7, 2024

(65) Prior Publication Data

US 2025/0366672 A1 Dec. 4, 2025

(30) Foreign Application Priority Data

Aug. 30, 2022 (CN) ..... 202222327803.0

(51) Int. Cl.
*A47K 3/28* (2006.01)

(52) U.S. Cl.
CPC ..... *A47K 3/282* (2013.01)

(58) Field of Classification Search
CPC ..... A47K 3/282; A47K 3/122; F16B 47/00
See application file for complete search history.

(56) References Cited

U.S. PATENT DOCUMENTS 2,813,276 A * 11/1957 Lanza ..... A47K 3/122 4/579
5,140,713 A 8/1992 Pesterfield
(Continued)

FOREIGN PATENT DOCUMENTS

CN 202235033 U 5/2012
CN 202312201 U 7/2012
(Continued)

OTHER PUBLICATIONS

Aug. 18, 2025 Search Report issued in European Patent Application No. 23858887.5.
(Continued)

*Primary Examiner* — Christine J Skubinna
(74) *Attorney, Agent, or Firm* — Oliff PLC

(57) ABSTRACT

A shower chair relates to a shower-aid apparatus and overcomes the drawbacks of suction cups of existing shower chairs which are difficult to release; a technical solution for solving the problem mainly includes a chair body and a suction cup disposed under a base of the chair body; the shower chair further includes a release lever for releasing the suction cup by pulling, and a release lever holding portion is arranged on the chair body, the release lever being securely held on the release lever holding portion after the suction cup is pulled up and released. The structure serves to facilitate release of the suction cup of the shower chair.

9 Claims, 5 Drawing Sheets

(56) References Cited

U.S. PATENT DOCUMENTS

| | | | | | |
|---|---|---|---|---|---|
| 5,454,540 | A | * | 10/1995 | McPherson | A47B 91/00<br>248/205.8 |
| 9,468,573 | B2 | * | 10/2016 | Edwards | A61G 7/1059 |

FOREIGN PATENT DOCUMENTS

| | | | | | |
|---|---|---|---|---|---|
| CN | 203736080 | U | | 7/2014 | |
| CN | 204318595 | U | * | 5/2015 | |
| CN | 205707757 | U | | 11/2016 | |
| CN | 108324066 | A | | 7/2018 | |
| CN | 108612408 | A | | 10/2018 | |
| CN | 215777652 | U | | 2/2022 | |
| CN | 114305175 | A | | 4/2022 | |
| CN | 218419572 | U | | 2/2023 | |
| GB | 2455616 | A | * | 6/2009 | A61G 7/10 |
| JP | H1052331 | A | * | 2/1998 | |
| JP | 2000-041879 | A | | 2/2000 | |
| JP | 2003-125966 | A | | 5/2003 | |

OTHER PUBLICATIONS

Sep. 22, 2023 Search Report issued in International Patent Application No. PCT/CN2023/103786.
Sep. 22, 2023 Written Opinion issued in International Patent Application No. PCT/CN2023/103786.

* cited by examiner

SHOWER CHAIR

FIELD

The subject matter described herein relates to a shower-aid apparatus, and more particularly relates to a shower chair.

BACKGROUND

A shower chair is an assistive device for showering or bathing, particularly to those seniors or patients with limited mobility or balance issues.

A conventional shower chair is generally provided with a suction cup under its base for anti-skidding purposes. To remove the shower chair from the shower stall or bathtub after showering or bathing, a user needs to break the negative suction pressure to pull up the suction cup; however, since the existing suction cup, after being pulled up, fails to securely peel off the ground/tub surface, a negative pressure would easily form under self-weight of the shower chair so that the suction cup would be stuck to the ground/tub surface again, which increases the difficulty in removing the shower chair; particularly to those seniors or patients with limited mobility or balance issues, the experience would be deteriorated.

SUMMARY

A shower chair is provided, which overcomes the drawbacks of a conventional shower chair whose suction cup, after being pulled up, fails to securely peel off the ground/tub surface so that a negative pressure easily forms under the self-weight of the shower chair and the suction cup would be re-stuck to the ground/tub surface causing difficulty in removing the shower chair; the shower chair described herein eases release of the suction cup.

The disclosure offers the technical solution below: a shower chair, comprising a chair body and a suction cup disposed under a base of the chair body, wherein the shower chair further comprises a release lever configurable to release the suction cup by pulling, and a release lever holding portion is arranged on the chair body, the release lever being securely held on the release lever holding portion after the suction cup is pulled up and released.

With this technical solution, the disclosure offers the following benefits: the release lever is securely held by the release lever holding portion; the "securely held" here mainly refers to securing the release lever positioned on the release lever holding portion, which can correspondingly hold the position of the suction cup with the negative pressure evacuated, so that the released suction cup would not re-form a negative pressure under the self-weight of the shower chair and the shower chair would not be stuck to the ground/tub surface again, thereby facilitating release of the suction cup of the shower chair; even to those seniors or patients with limited mobility or balance issues, they can also release the suction cup easily, significantly enhancing user experience.

Furthermore, the release lever holding portion is disposed above the release lever, the suction cup is pulled upward via the release lever which is then held on the release lever holding portion. With this technical solution, the suction cup is pulled upward via the release lever which is then held on the release lever holding portion to realize release of the suction cup, which is particularly convenient for a user sitting on the shower chair to operate; this arrangement can reduce an amplitude of the user tilting towards one side of the shower chair, facilitates maintaining stability of the shower chair, and effectively avoids the shower chair from tipping over; in addition, this arrangement may also form a height difference between the pulled suction cup and the ground/tub surface, further preventing the suction cup from sticking to the ground/tub surface again.

Furthermore, a plurality of suction cups are arranged at intervals under a base of the chair body, at least two release levers being provided and engaged with the suction cups at different positions, respectively. With this technical solution, since the at least two release levers engage the suction cups at different positions respectively, after the suction cups at different positions are released, all of the release levers can be held by the release lever holding portions; this arrangement effectively prevents the suction cup at another position from forming a negative pressure under the self-weight of the shower chair so as to be stuck again after the suction cup at one position is released, so that the user can easily release the suction cups by himself/herself, significantly enhancing user experience.

Furthermore, the release lever holding portion is formed of a hook, the release lever being hooked up to the hook. With this technical solution, by hooking up the suction cup to the hook, the suction cup completely peels off the ground/tub surface, which effectively prevents the suction cup from re-sticking to the ground/tub surface; this may also simplify the removal process and facilitates the user to remove the shower chair.

Furthermore, a finger groove facilitating grip is formed on the release lever, the finger groove being at least partially hooked up to the hook. With this technical solution, the finger groove as provided facilitates the user to grip the release lever against skidding, thereby facilitating the release lever to perform the action of pulling up the suction cup; in addition, the finger groove hooked up to the hook may also play a role of limiting the hook, which facilitates enhancing attachment reliability between the release lever and the hook and effectively prevents the release lever from detachment from the hook so that the suction cup would not be re-stuck to the ground/tub surface.

Furthermore, a first magnetic piece is arranged on the release lever holding portion, and a second magnetic piece is arranged on the release lever, the first magnetic piece and the second magnetic piece being attracted with each other. With this technical solution, since the first magnetic piece and the second magnetic piece are attracted with each other, reliable engagement between the release lever and the release lever holding portion is realized, so that the release lever held by the release lever holding portion is not easily detached, effectively preventing the suction cup from being re-stuck to the ground/tub surface.

Furthermore, the release lever engages at least two suction cups. With this technical solution, simultaneous pulling of the plurality of suction cups is realized, which reduces the times of pulling and further facilitates the user to remove the shower chair.

Furthermore, a protruding first connecting tab is arranged at an outer side of each of the at least two suction cups, a first connecting hole is formed on the first connecting tab, and a rotatable snap is arranged on the release lever, the snap passing through the first connecting hole and being rotatably snap-fitted on the first connecting tab. With this technical solution, detachable connection between the release lever and the suction cup is realized, which not only facilitates later maintenance but also may reduce footprint of the shower chair to facilitate transportation.

Furthermore, a protruding second connecting tab is arranged at an outer side of each of the at least two suction cups, and a second connecting hole is formed on the second connecting tab, the release lever of a rod shape passing through the second connecting holes on the at least two suction cups, two ends of the release lever being axially limited by a retainer ring. This technical solution allows for reliable connection between one single release lever and a plurality of suction cups, which correspondingly realizes simultaneously pulling of the plurality of suction cups, thereby facilitating release of the suction cups.

Furthermore, the suction cup is attached to the chair body via a rotary shaft or a universal joint. This technical solution realizes angle adjustability of the suction cup, so that the suction cup can be conformingly fitted to ground/tub surfaces of various angles to satisfy application to the ground/tub surfaces of various angles; in this way, the attachment between the shower chair and the ground/tub surface is more secure and reliable, significantly enhancing use safety.

BRIEF DESCRIPTION OF THE DRAWINGS

Hereinafter, the disclosure will be further explained through the drawings below.

Figure 1:
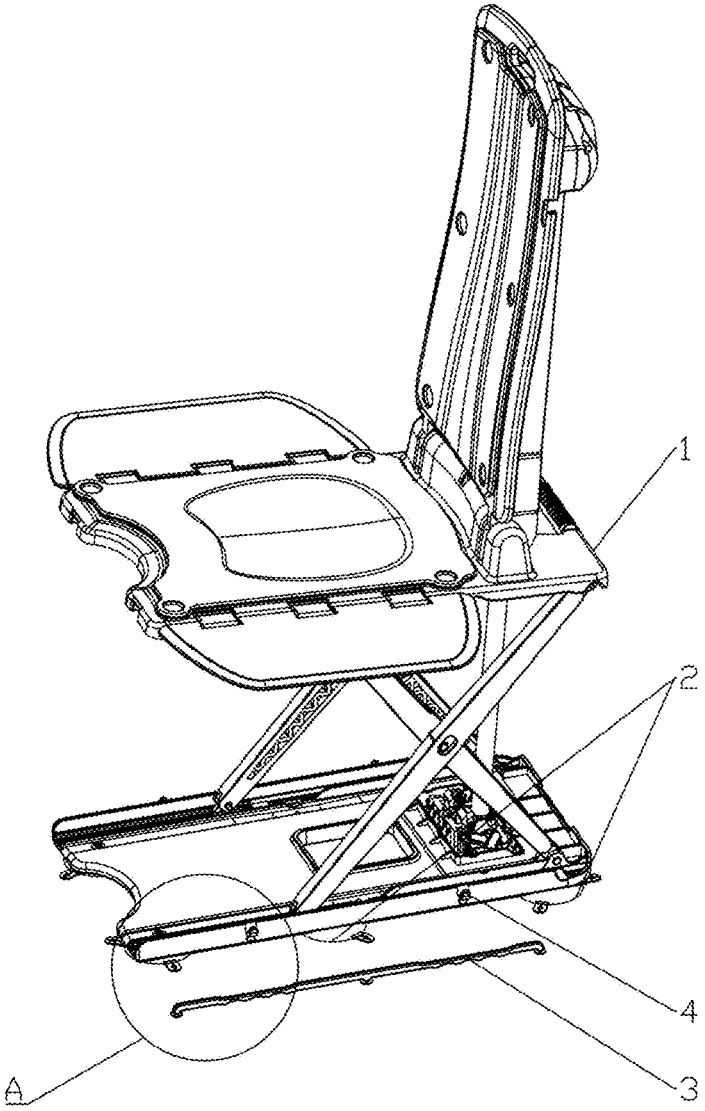
FIG. 1 is a structural schematic diagram of a shower chair according to the disclosure.

In the drawings: 1. chair body; 11. supporting shaft; 2. suction cup; 21. first connecting tab; 211. first connecting hole; 22. second connecting tab; 221. second connecting hole; 23. third connecting tab; 231. third connecting hole; 24. first mounting cavity; 3. release lever; 31. finger groove; 32. retainer ring; 33. snap; 4. release lever holding portion; 51. first connecting rod; 52. ball head; 53. flexible block; 531. second mounting cavity.

DETAILED DESCRIPTION OF EMBODIMENTS

To make the objectives, technical solutions, and advantages of the embodiments of the disclosure more apparent, the technical solutions in the embodiments of the disclosure will be described in a clear and comprehensive manner with reference to the accompanying drawings; it is apparent that the example embodiments described herein are only part of the embodiments of the disclosure, not all of them.

The terms such as "first," "second," "third," and "fourth" (if existent) referred to in the specification and claim of the disclosure are used for distinguishing like objects, not necessarily used for describing a specific sequence or priority. It is understood that the data modified with such terms may be replaceable with each other in appropriate circumstances so that the embodiments of the disclosure as described herein may also be implemented in sequences aside from those illustrated or described herein.

It is understood that, in various embodiments of the disclosure, the serial numbers involved in respective steps do not indicate sequences of their execution; instead, the execution sequences of respective steps shall be determined based on the functions and inherent logic; therefore, the serial numbers shall not constitute any limitation to the execution process of the embodiments of the disclosure.

It is understood that the terms "comprise" and "have," as well as any of their variants, intend for a non-exclusive inclusion. For example, a process, method, system, product, or apparatus comprising a series of steps or units is not limited to the steps or units listed, but may comprise other steps or units which are not explicitly listed or which are inherent in the process, method, product, or apparatus.

It is understood that in the disclosure, the term "plurality" refers to two or more. The term "and/or" only describes an association relationship of associated objects, which indicates that there may exist three relationships, e.g., X and/or Y may indicate three circumstances: X individually, or both X and Y together, or Y individually. The character "/" generally indicates a relationship of "or" between the former and latter associated objects. The term "comprising X, Y, and Z" or "comprising X, Y, Z" refers to comprising all of X, Y, and Z; the term "comprising X, Y, or Z" refers to comprising one of X, Y, and Z; the term "comprising X, Y and/or Z" refers to comprising any one, or any two, or three of X, Y, and Z.

Hereinafter, the technical solution of the disclosure will be described in detail through specific implementations. The specific implementations described infra may be combined or replaced with each other dependent on actual circumstances, and same or similar concepts or processes may be omitted in some implementations.

Figure 2:
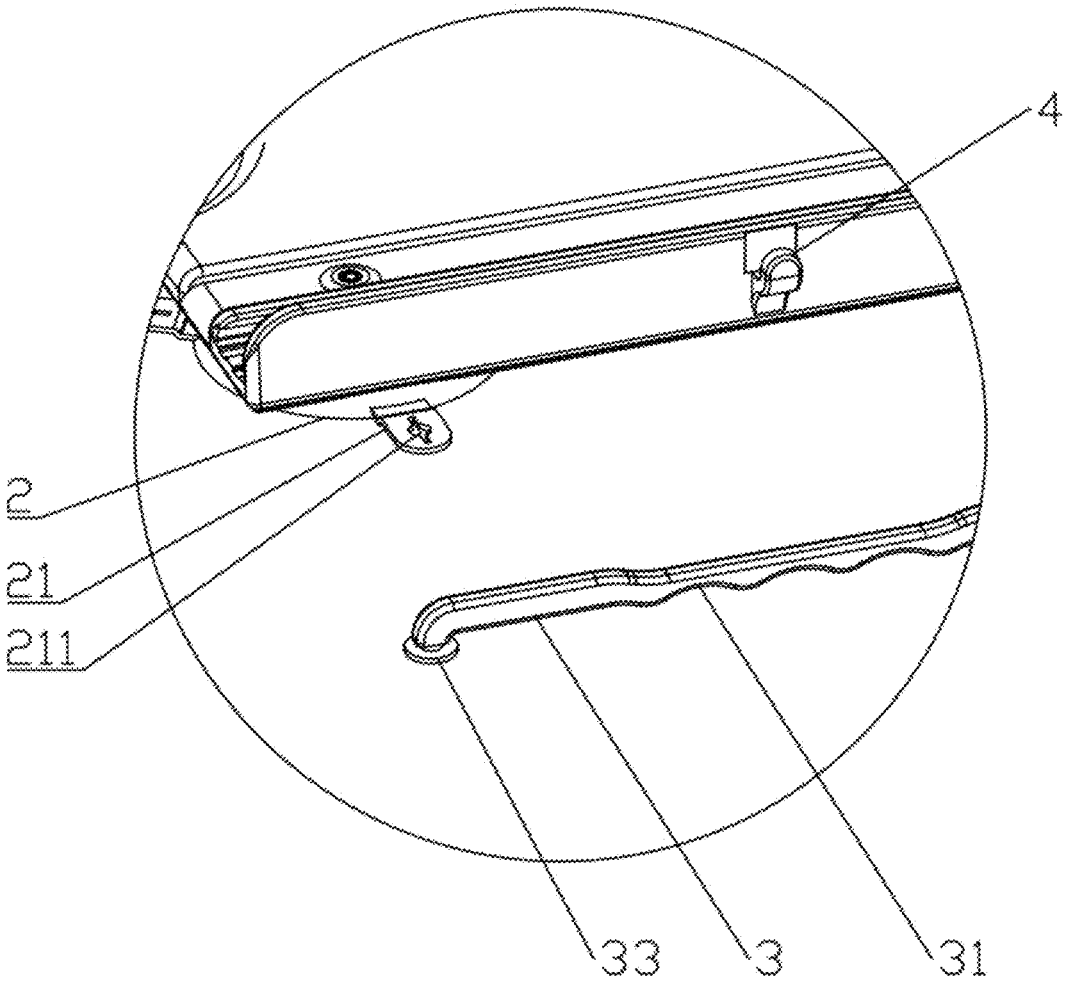
FIG. 2 is an enlarged view of the structure at part A in FIG. 1.

As illustrated in FIGS. 1 and 2, the disclosure provides a shower chair, comprising a chair body 1 and a suction cup 2 disposed under a base of the chair body 1, the suction cup 2 being configurable to securely stick the shower chair to a slippery ground/tub surface so as to effectively prevent the shower chair from skidding.

To facilitate release of the suction cup 2, the shower chair described herein further comprises a release lever 3 configurable to release the suction cup 2 by pulling, a release lever holding portion 4 being arranged on the chair body 1; this allows for the release lever 3 to be securely held on the release lever holding portion 4 after the suction cup 2 is pulled up and released.

This structure allows for the release lever 3 to be securely held via the release lever holding portion 4. The "securely held" here mainly refers to securing the release lever 3 positioned on the release lever holding portion 4, which can correspondingly hold the position of the suction cup 2 with the negative pressure evacuated, so that the released suction cup 2 would not re-form a negative pressure under the self-weight of the shower chair and the shower chair would not be stuck to the ground/tub surface again, thereby facilitating release of the suction cup 2 of the shower chair. Even to those seniors or patients with limited mobility or balance issues, they can also release the suction cup easily, significantly enhancing user experience.

It is noted that, pulling up and releasing the suction cup 2 via the release lever 3 mainly means the negative-pressure suction of the suction cup 2 is broken by pulling via the release lever 3, whereby the suction cup 2 is released.

In this implementation, the release lever holding portion 4 is disposed above the release lever 3, the suction cup 2 is pulled upward via the release lever 3 which is then securely held on the release lever holding portion 4 to realize release of the suction cup 2, which is particularly convenient for a user sitting on the shower chair to operate; this arrangement can reduce an amplitude of the user tilting towards one side of the shower chair, facilitates maintaining stability of the shower chair, and effectively avoids the shower chair from tipping over; in addition, this arrangement may also form a height difference between the pulled suction cup 2 and the ground/tub surface, further preventing the suction cup 2 from sticking to the ground/tub surface again.

To prevent the shower chair from skidding, a plurality of suction cups 2 are arranged at intervals under the base of the chair body 1, which increases a suction area with the ground/tub surface, effectively secures the shower chair, prevents shifting of the shower chair, and maintains structural stability.

Correspondingly, to further facilitate release of the suction cup 2, at least two release levers 3 are attached to the suction cups 2 at different positions, respectively, so that after the suction cups 2 at different positions are released, all of the release levers 3 can be held up by the release lever holding portions 4; this arrangement effectively prevents the suction cup 2 at another position from forming a negative pressure under the self-weight of the shower chair to be stuck again after the suction cup 2 at one position is released, so that the user can easily release the suction cups 2 by himself/herself, significantly enhancing user experience.

It is noted that, a release lever holding portion 4 fitted with the release lever 3 is arranged on the chair body 1.

Since a plurality of suction cups 2 are provided, to further facilitate release of the suction cups 2, in this implementation, the release lever 3 engages at least two suction cups 2 to realize simultaneous pulling of the plurality of suction cups 2, which reduces the number of times of pulling and further facilitates the user to remove the shower chair.

In this implementation, the release lever holding portion 4 is formed of a hook, so that the release lever 3 is hooked up to the hook. By hooking up the release lever 3 to the hook, the suction cup peels off the ground/tub surface, which effectively prevents the suction cup 2 from re-sticking to the ground/tub surface; this may also simplify the removal process and facilitates the user to remove the shower chair.

To further facilitate user operation, a finger groove 31 facilitating hand grip is formed on the release lever 3, the finger groove 31 being at least partially hooked up to the hook. Since the surface of the release lever 3 becomes slippery after showering, the finger groove 31 facilitates the user to grip the release lever 3 against skidding, thereby facilitating the release lever 3 to perform the action of pulling up the suction cup 2; in addition, the finger groove 31 hooked up to the hook may also play a role of limiting the hook, which facilitates enhancing attachment reliability between the release lever 3 and the hook and effectively prevents the release lever 3 from detachment from the hook 2 so that the suction cup 2 would not be re-stuck to the ground/tub surface.

To implement reliable attachment between the release lever 3 and the suction cup 2, a protruding first connecting tab 21 is arranged at an outer side of the suction cup 2, a first connecting hole 211 is formed on the first connecting tab 21, and a rotatable snap 33 is arranged on the release lever 3, the snap 33 passing through the first connecting hole 211 and being rotatably snap-fitted on the first connecting tab 21. This detachable connection between the release lever 3 and the suction cup 2 not only facilitates later maintenance but also may reduce footprint of the shower chair to facilitate transportation.

It is noted that, in this implementation, the release lever 3 engages a plurality of suction cups 2, which realizes simultaneously pulling of the plurality of suction cups 2, thereby facilitating removal of the shower chair.

It is noted that, the release lever 3 may be a rigid member to facilitate pulling the suction cup 2; of course, in other implementations, the release lever 3 may also be a flexible member, which effectively prevents rigid collision between the user and the release lever 3 during operation, thereby enhancing use safety of the shower chair.

Figure 3:
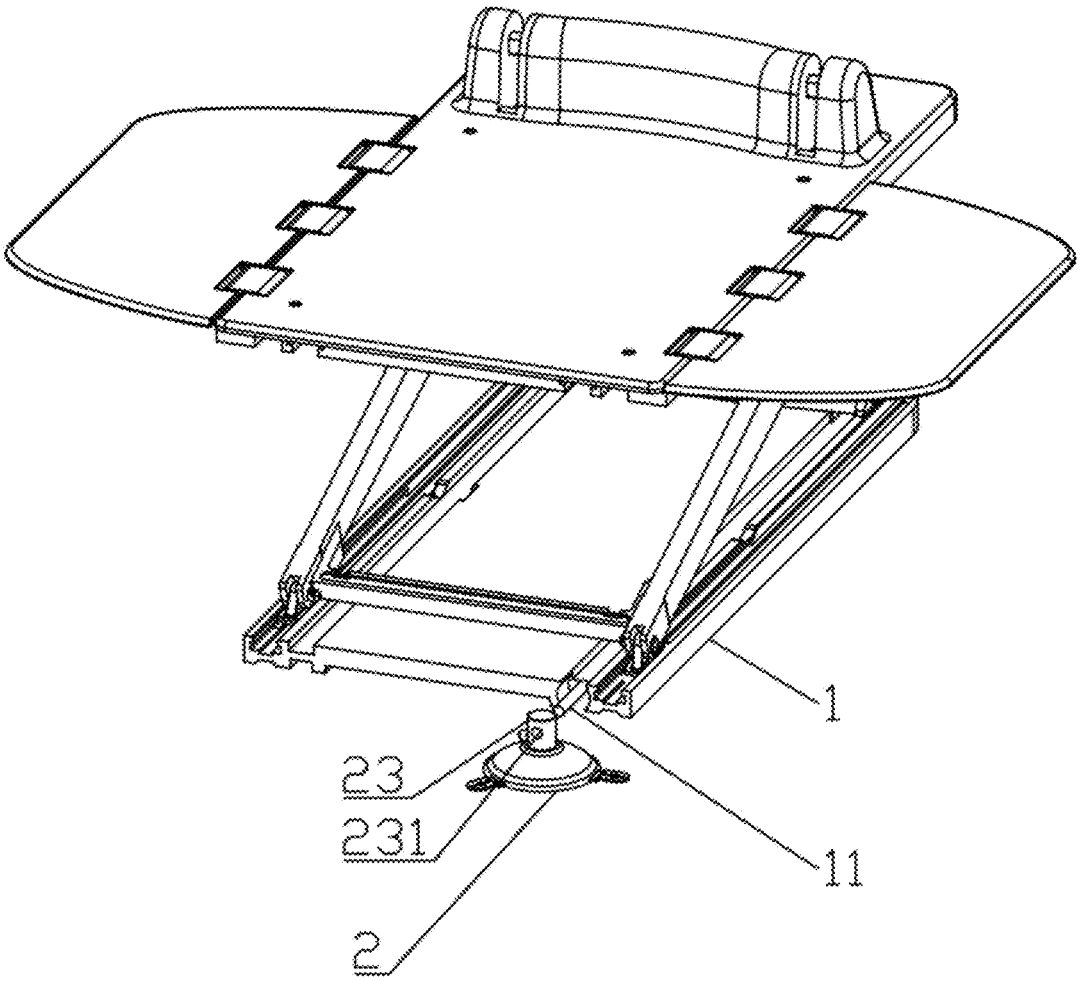
FIG. 3 is a structural schematic diagram of a shower chair in a first implementation.

To facilitate using the shower chair, as illustrated in FIG. 3, in this implementation, the suction cup 2 and the chair body 1 are connected via a rotary shaft, which realizes angle adjustability of the suction cup 2, so that the suction cup 2 can be conformingly fitted to ground/tub surfaces of various angles to satisfy application to the ground/tub surfaces of various angles; in this way, the attachment between the shower chair and the ground/tub surface is more secure and reliable, significantly enhancing use safety.

It is noted that, the ground/tub surface here may refer to the ground of the shower stall or a bottom surface of a bathtub; the disclosure is not limited thereto.

Specifically, a protruding third connecting tab 23 is arranged at an outer side of the suction cup 2, a third connecting hole 231 is formed on the third connecting tab 23, and a supporting shaft 11 is provided for the chair body 1, the supporting shaft 11 passing through the third connecting hole 231. During operating, the suction cup 2 is rotated to implement angle adjustment so that the suction cup 2 is completely conformingly fitted to a curved ground profile, which can effectively evacuate the air between the suction surface of the suction cup 2 and the ground/tub surface to form a negative pressure, causing the suction cup 2 to be completely stuck to the curved ground; in this way, the shower chair does not easily skid and is positioned safely and reliably.

Figure 4:
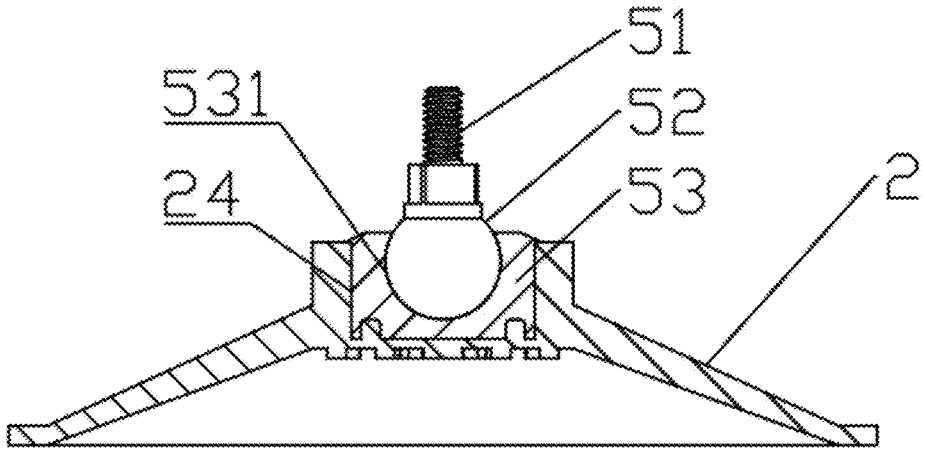
FIG. 4 is a structural schematic diagram of a universal joint in the first implementation.
Figure 5:
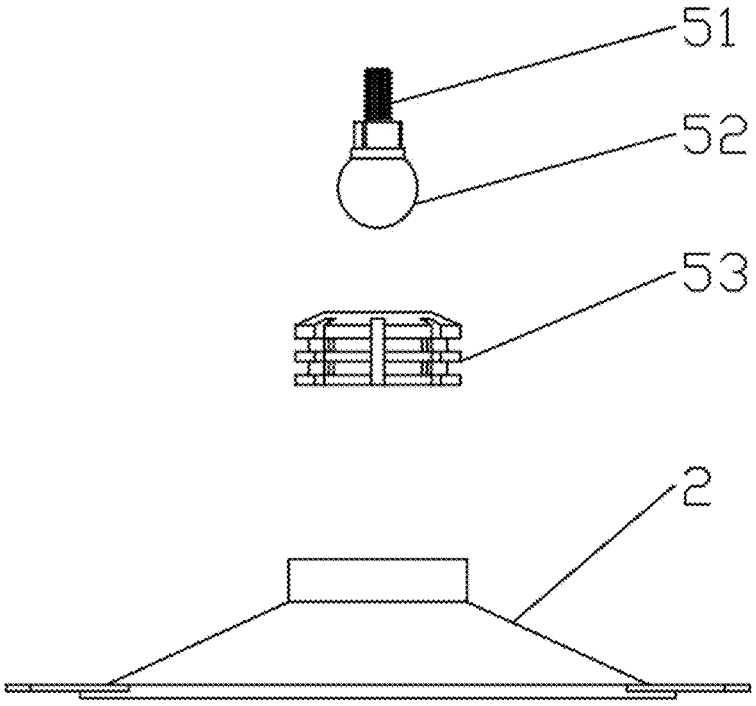
FIG. 5 is an exploded view of the universal joint in the first implementation.

It may be understood that, as illustrated in FIGS. 4 and 5, in other implementations, the suction cup 2 and the chair body 1 may be attached via a universal joint. The universal joint comprises a first connecting rod 51, a ball head 52 disposed at one end of the first connecting rod 51, and a first mounting cavity 24 disposed on the suction cup 2, inside the first mounting cavity 24 being provided a flexible block 53, on the flexible block 53 being formed a second mounting cavity 531 matched with the ball head 52, the ball head 52 being mounted in the second mounting cavity 531, an opposite end of the first connecting rod 51 being attached to the chair body 1; this not only realizes angle adjustability of the suction cup 2, but also may prevent rigid contact between the ball head 52 and the suction cup 2, thereby extending service life of the product.

It is noted that, in this implementation, the first connecting rod 51 is a threaded rod, the first connecting rod 51 being in threaded connection with the chair body 1; of course, in alternative implementations, the first connecting rod 51 may also be formed of another appropriate structure.

Second Implementation

In this implementation, a first magnetic piece is provided on the release lever holding portion 4, and a second magnetic piece is provided on the release lever 3, the first magnetic piece and the second magnetic piece being attracted with each other, which realizes reliable connection between the release lever 3 and the release lever holding portion 4, so that the release lever 3 held up by the release lever holding portion 4 is not easily detached, effectively preventing re-sticking of the suction cup 2.

In this implementation, the first magnetic piece and the second magnetic piece are magnets; of course, in alternative implementations, they may be formed of other magnetic materials.

Other contents not described in this implementation may refer to the first implementation.

It is noted that, a first magnetic piece is provided for the release lever holding portion 4 formed of a hook, while a second magnetic piece is provided on the release lever 3, whereby dual fixation is created, which further prevents the release lever 3 from detachment and effectively prevents re-sticking of the suction cup 2.

Third Implementation

Figure 6:
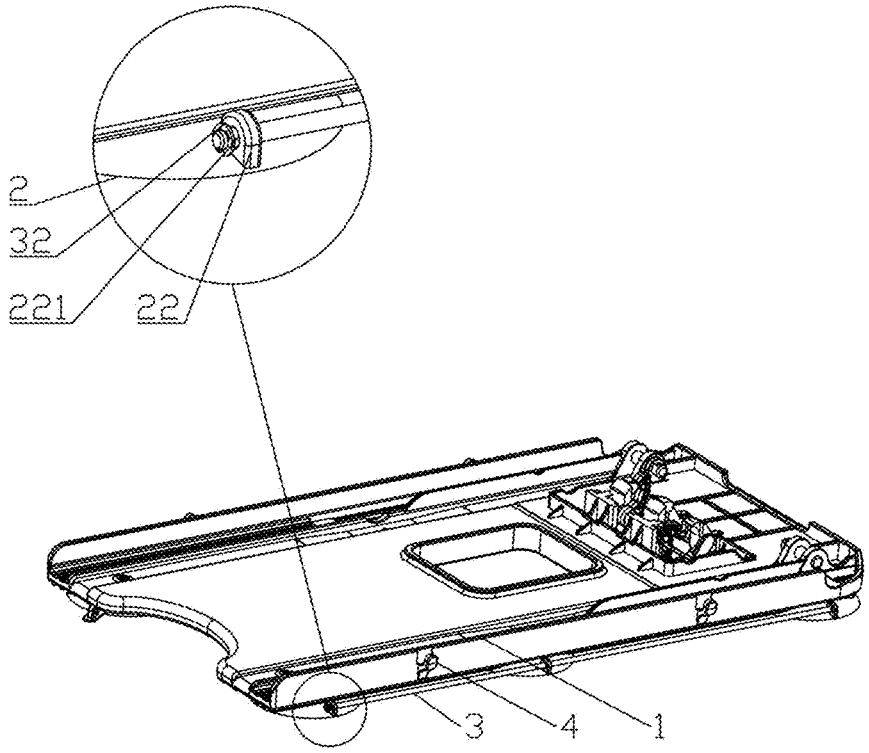
FIG. 6 is a structural schematic diagram of a shower chair in a third implementation.

As illustrated in FIG. 6, in this implementation, a protruding second connecting tab 22 is arranged at an outer side of the suction cup 2, and a second connecting hole 221 is formed on the second connecting tab 22; the release lever 3 formed of a rod shape passes through the second connecting holes 221 on at least two suction cups 2, two ends of the release lever 3 being axially limited by a retainer ring 32. This structure may also realize reliable engagement between one single release lever 3 and a plurality of suction cups 2, which correspondingly realizes simultaneously pulling of the plurality of suction cups 2, thereby facilitating release of the suction cups 2.

It is noted that, there may be provided only one second connecting tab 22 so that the engagement position between the release lever 3 and the suction cup 2 is fixed; there may also be provided two or another appropriate number of second connecting tabs 22, so that after the rotatable suction cup 2 is rotated, the positions where the release lever 3 and the suction cups 2 are engaged always maintain consistent to facilitate pulling of the release lever 3.

Other contents not described in this implementation may also refer to the preceding implementations.

The implementations described supra are only intended for illustrating the disclosure, not for limiting the scope of the disclosure. To those skilled in the art, various modifications and alterations may be made based on the technical solution and the idea described supra, while all of such modifications and alterations shall fall within the scope of protection of the appended claims.

We claim:

1. A shower chair, comprising:

a chair body, a suction cup disposed under a base of the chair body, a release lever configurable to release the suction cup by an upward pulling force exerted by a user, and a release lever holding portion is arranged on the chair body above the release lever, the release lever holding portion being configured to securely hold the release lever after the suction cup is pulled up and released, such that the suction cup is retained in a pulled-up state after the upward pulling force exerted by the user is released.

2. The shower chair according to claim 1, wherein the suction cup comprises a plurality of suction cups are arranged at intervals under the base of the chair body, and the release lever comprises at least two release levers provided and engaged with the suction cups at different positions, respectively.

3. The shower chair according to claim 1, wherein the release lever holding portion is formed of a hook, the release lever being hooked up to the hook.

4. The shower chair according to claim 3, wherein a finger groove facilitating grip is formed on the release lever, the finger groove being at least partially hooked up to the hook.

5. The shower chair according to claim 1, wherein a first magnetic piece is arranged on the release lever holding portion, and a second magnetic piece is arranged on the release lever, the first magnetic piece and the second magnetic piece being attracted with each other.

6. The shower chair according to claim 1, wherein the suction cup comprises at least two suction cups, and the release lever engages the at least two suction cups.

7. The shower chair according to claim 6, wherein a protruding first connecting tab is arranged at an outer side of each of the at least two suction cups, a first connecting hole is formed on the first connecting tab, and a rotatable snap is arranged on the release lever, the snap passing through the first connecting hole and being rotatably snap-fitted on the first connecting tab.

8. The shower chair according to claim 6, wherein a protruding second connecting tab is arranged at an outer side of each of the at least two suction cups, and a second connecting hole is formed on the second connecting tab, the release lever of a rod shape passing through the second connecting holes on the at least two suction cups, two ends of the release lever being axially limited by a retainer ring.

9. The shower chair according to claim 1, wherein the suction cup is attached to the chair body via a rotary shaft or a universal joint.

* * * * *